United States Patent [19]

Chica

[11] 3,942,692

[45] Mar. 9, 1976

[54] SPRING-RELEASE SAFETY HOLSTER

[76] Inventor: Quentin J. Chica, 104 Draper St., Springfield, Mass. 01108

[22] Filed: Mar. 22, 1974

[21] Appl. No.: 454,361

[52] U.S. Cl. ..... 224/2 B
[51] Int. Cl.[2] ..... F41C 33/02
[58] Field of Search ..... 224/2 B, 2 A, 2 C, 2 D, 224/2 E, 2 F, 26 R

[56] References Cited

UNITED STATES PATENTS

| | | | |
|---|---|---|---|
| 1,320,751 | 11/1919 | Freyer | 224/2 B |
| 1,844,603 | 2/1932 | Sarson | 224/2 B |
| 2,001,321 | 5/1935 | Berns | 224/2 B |
| 2,577,869 | 12/1951 | Adams | 224/2 B |

*Primary Examiner*—Robert J. Spar
*Assistant Examiner*—Jerold M. Forsberg
*Attorney, Agent, or Firm*—LeBlanc & Shur

[57] ABSTRACT

A belt revolver holster with the pocket formed of one piece of leather folded symetrically along the front edge then welted and stitched closed along the back edge.

The revolver is held securely in place by a ⅝ inch × 3 inch flat leaf spring inserted and stitched in place along the vertical front edge of the holster pocket. The spring, bent to an approximate angle of 25° presses against the revolver frame forcing it back agaist a nylon welt which is shaped to, and houses most of the revolver trigger guard.

The revolver then can be released only by grasping the butt and by using a clockwise pivoting motion. The same motion or "draw" taught in most police weapon training schools.

The revolver pocket is stitched to two 1½ inch strips which protrude, one to the front, and one to the rear of the holster.

The strips are in turn fastened to the waist belt by means of Velcro straps which when wrapped around the waist belt allow an adjustment and hold securely to most standard belt widths.

9 Claims, 2 Drawing Figures

SPRING-RELEASE SAFETY HOLSTER

BACKGROUND

Figure 1:
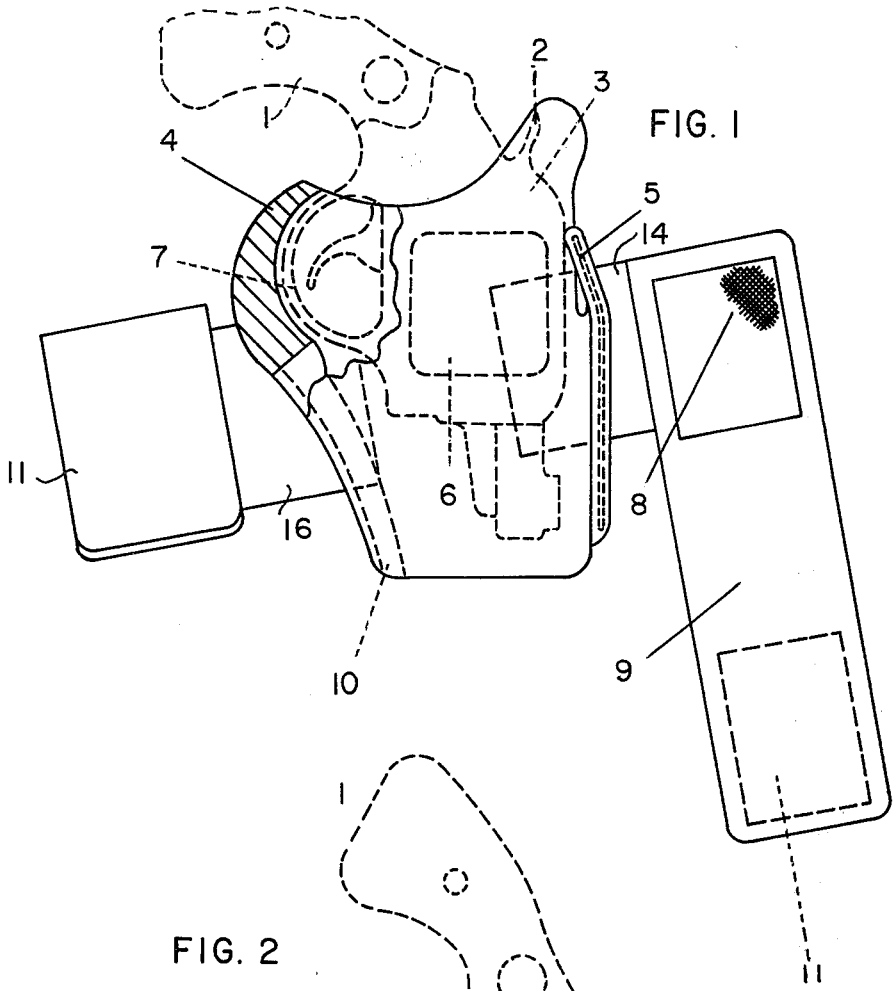

The invention relates to firearms generally and more particularly to a gun holster for side arms.

The object of the invention is to provide a secure holster for a hand gun or side arm, such as those carried by under-cover police officers, which permits maximum concealment, fast and natural drawing motion without breakout, and a safety device against unauthorized removal from behind.

SUMMARY

The present invention relates to off duty and undercover style revolver holsters.

It fills several requirements, such as:

1. The revolver is held securely when wearer runs, jumps, or is engaged in violent physical combat.
2. The revolver butt is hang close to the body, the revolver does not "hand out".
3. The revolver cannot be jerked from the holster by a person standing behind the wearer.
4. The revolver is released only by a natural drawing motion.
5. Revolver can be replaced in the holster easily with one hand.
6. The holster can be worn with any standard width belt as the fastening device is adjustable.
7. The holster is designed for maximum concealment and minimum bulk.
8. The holster has no revolver retaining straps or snap fasteners to slow or impede the drawing of the revolver.

DRAWINGS

Figure 2:
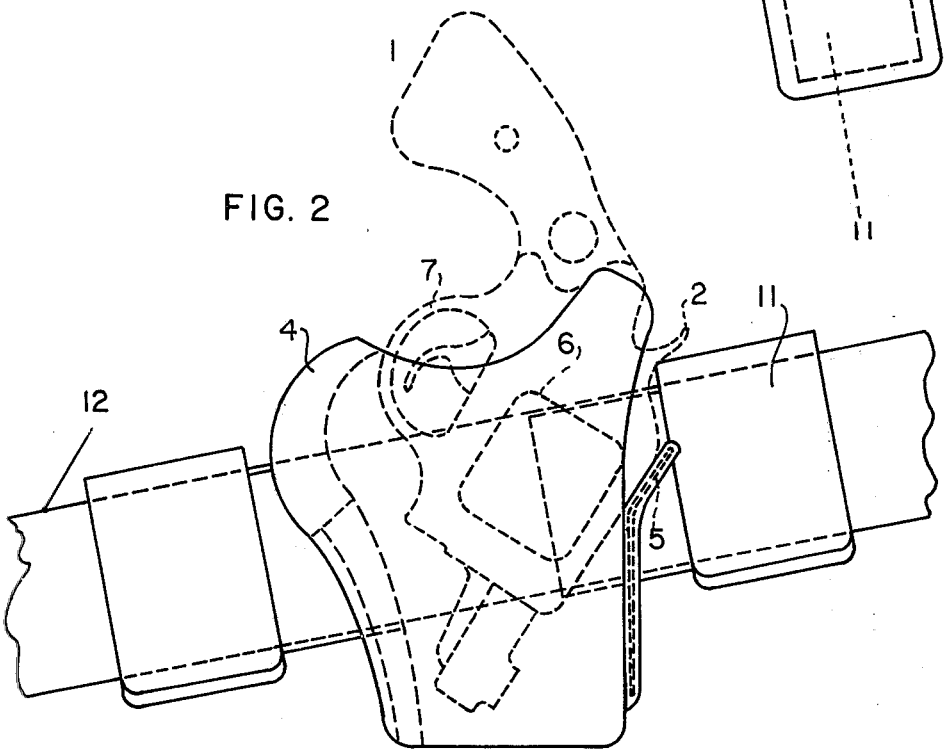

FIG. 1 is a side elevational view of a holster constructed in accordance with the present invention with parts broken out and in cross section for ease of illustration and illustrating a hand gun in carrying position within the holster; and FIG. 2 is a side elevational view similar to FIG. 1 illustrating the manner in which the hand gun is withdrawn or inserted into the holster.

DESCRIPTION

Reference is now made more particularly to the drawing which illustrates the component parts of the invention with the practical application of the theory with reference to a hand gun in a secure position and a drawn position. The fire arm herein is a hand gun including the hand grip 1, the hammer 2, the frame 3, the cylinder 6, and the trigger guard 7.

The holster is formed of one piece of leather folded along the front edge then welted and stitched closed along the back edge 10.

In order to secure the hand gun in the holster a ⅝ inch ×3 inch flat leaf spring 5 is inserted and stitched in place along the vertical front edge of the holster pocket. The spring, bent to an approximate angle of 25° presses against the revolver frame 3 forcing it back against a nylon welt 4 which is shaped to, and houses most of the revolver trigger guard 7.

The hand gun then can be released by grasping the butt 1 and by using a clockwise pivoting motion, same motion or "draw" taught in most police weapon training schools.

The revolver pocket is stitched to two 1½ inches strips 14 and 16 respectively which protrude, strip 14 to the front, and strip 16 to the rear of the holster. The strips are in turn fastened to the waist belt 12 by means of straps 11 carrying "Velcro" type fasteners which when wrapped around the waist belt 12 allow an adjustment and hold securely to most standard belts.

With the hand gun carried within the holster as illustrated in FIG. 1, it will be appreciated that the upper end portion of the leaf spring 5 bears against the top of the gun frame biasing the hand gun rearwardly to maintain the trigger guard 7 in engagement with and within the trigger guard housing 4. Consequently the opening at the upper end of the holster body in a forward to rearward direction is smaller than the dimension of the hand gun from the top of its frame to the bottom of the trigger guard within the holster whereby the handgun cannot be withdrawn directly through the opening at the upper end of the holster body. To withdraw the handgun from the holster, the handgun is rotated forwardly against the bias of the leaf spring 5 to bend the upper portion of the spring forwardly as illustrated in FIG. 2. This movement rotates the trigger guard 7 forwardly and away from the trigger guard housing 4 substantially to the position illustrated in FIG. 2 whereby the handgun is in position for full withdrawal from the holster. To insert the handgun into the holster, the reverse procedure is followed. That is, tha handgun is disposed within the holster body at substantially the angle illustrated in FIG. 2 with the upper end of the leaf spring being bent forwardly. The handgun is then pushed into the body and the leaf spring biases the handgun in a rearward direction finally clamping the handgun within the holster body between the upper portion of the spring and the trigger guard housing 4.

While a preferred embodiment of the invention has herein been illustrated and described, it has been done by way of illustration and not limitation, and the invention should not be limited except as required by the scope of the appended claims.

Having described my invention, what I claim and desire to secure by Letters Patent is:

1. A holster for a handgun having a frame, a barrel, a trigger guard and a hand grip comprising a holster having spaced opposed side walls and means interconnecting the side walls at the respective forward and rear ends of said holster body whereby said holster body defines a pocket open at its upper end for receving the handgun, and means carried by said body for releasably retaining the handgun within said pocket including means adjacent the rear end of said body and said opening engageable with the trigger guard of the handgun to prevent direct withdrawal of the handgun from said pocket through the open upper end of said body, resilient means carried by said body adjacent its forward end engageable with the handgun frame for biasing the handgun in a rearward direction such that the trigger guard engageable means is maintained in engagement with the trigger guard, said resilient means comprises an upstanding elongated leaf spring, means for substantially rigidly securing the lower portion of said leaf spring to said holster body at the forward end thereof, the upper portion of said spring being disposed adjacent the open upper end of the holster body and being flexible for movement in generally forward and rearward directions between a normally disposed rearward position engageable with the handgun frame to retain the handgun in the holster pocket and a forwardly disposed rearwardly biased position enabling withdrawal of the handgun from the holster, said resilient means being movable forwardly against its bias in response to movement of the handgun forwardly within said pocket to disengage the trigger guard of the handgun from the trigger guard engagement means thereby enabling withdrawal of the handgun from the holster through its open upper end.

2. A holster according to claim 1 wherein the connecting means at the forward end of said body includes a forward wall between said side walls, said spring extending vertically along the forward wall of said holster body over a major portion of the depth of said holster body.

3. A holster according to claim 1 including means carried by said holster body for releasably securing said holster to a belt worn by an individual carrying the holster.

4. A holster according to claim 1 wherein said holster body is formed of flexible material reversely folded, means at the rear end of said holster body for securing the free end of said reversely folded material one to the other, the upper portion of said holster body at its forward end being cut out, said resilient means comprising an upstanding elongated flat leaf spring, means for substantially rigidly securing a lower portion of said leaf spring to said holster body at the forward end thereof, the upper portion of said spring being disposed adjacent the open upper end of the holster body and within said cutout for engagement with the hand gun.

5. A holster according to claim 4 wherein the upper spring portion is bent such that it extends toward the rear end of said holster body.

6. A holster for a handgun comprising a body defining an elongated pocket having an opening at its upper end for receiving a handgun, means carried by said body at one end of said pocket and said opening for engaging a portion of the handgun, resilient means carried by said body at the opposite end of said pocket and said opening for engaging an opposite portion of the handgun, said resilient means comprises an upstanding leaf spring, means for substantially rigidly securing the lower portion of said leaf spring to said holster body at the forward end thereof, the upper portion of said spring being disposed adjacent the open upper end of the holster body and being flexible for movement in generally forward and rearward directions between a normally disposed rearward position engageable with the frame of the handgun to retain the handgun in the holster pocket and a forwardly disposed rearwardly biased position enabling withdrawal of the handgun from the holster, said resilient engaging means being normally biased toward the first mentioned engaging means into a first position defining a first predetermined distance between the respective engaging means at opposite ends of said opening, said resilient means in said first position enabling engagement of the handgun by said engaging means at opposite ends of said body for releasably retaining the handgun within the pocket of said holster body and being movable against its bias away from the first mentioned engaging means into a second position defining a second distance between the respective engaging means at opposite ends of said body greater than said first predetermined distance whereby the handgun is movable past said holster body opening.

7. A holster according to claim 6 including means carried by said holster body for releasably securing said holster to a belt worn by an individual carrying the holster.

8. A holster according to claim 6 wherein said holster body is formed of flexible material reversely folded, means at the rear end of said holster body for securing the free end of said reversely folded material one to the other, the upper portion of said holster body at its forward end being cut out, said resilient means comprising an upstanding elongated flat leaf spring, means for substantially rigidly securing a lower portion of said leaf spring to said holster body at the forward end thereof, the upper portion of said spring being disposed adjacent the open upper end of the holster body and within said cutout for engagement with the handgun.

9. A holster according to claim 8 wherein the upper spring portion is bent such that it extends toward the rear end of said holster body.

* * * * *

UNITED STATES PATENT AND TRADEMARK OFFICE

CERTIFICATE OF CORRECTION

PATENT NO. : 3,942,692

DATED : March 9, 1976

INVENTOR(S) : Quentin J. Chica

It is certified that error appears in the above-identified patent and that said Letters Patent are hereby corrected as shown below:

Col. 1, line 21, "hang" should be --held--; line 22, "hand" should be --hang--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*